United States Patent [19]

Bradfield

[11] 3,967,570

[45] July 6, 1976

[54] FLOATING DOCK BOAT LIFT

[76] Inventor: C. C. Bradfield, 175 E. Elmview, San Antonio, Tex. 78209

[22] Filed: July 7, 1975

[21] Appl. No.: 593,329

Related U.S. Application Data

[63] Continuation-in-part of Ser. No. 455,128, March 27, 1975, abandoned.

[52] U.S. Cl. ..... 114/45; 61/65

[51] Int. Cl.[2] ..... B63C 1/06

[58] Field of Search ..... 114/45–48, 114/.5 BD; 61/64–67

[56] References Cited

UNITED STATES PATENTS

| | | | |
|---|---|---|---|
| 3,270,698 | 9/1966 | Fort | 114/45 |
| 3,362,172 | 1/1968 | Rutter | 61/65 |
| 3,727,415 | 4/1973 | Williams | 61/65 |
| 3,734,046 | 5/1973 | Schmidt et al. | 114/.5 BD |
| 3,895,592 | 7/1975 | King | 114/45 |

*Primary Examiner*—Duane A. Reger
*Assistant Examiner*—Stuart M. Goldstein
*Attorney, Agent, or Firm*—Willard J. Hodges, Jr.

[57] ABSTRACT

A floating dock boat lift comprises a flat deck and a parent structure to which the deck is hinged. The free end of the deck over-lies a variable buoyancy chamber communicating by pipes or hoses to an inlet air pump on or near the parent structure and to an air release valve on or near the deck. Alternately, air venting, for buoyancy control in under-deck compartments, may be facilitated through valves at each compartment. The deck is provided with a combination metal and wood boat-supporting keel brace and underlying reinforcement members.

6 Claims, 3 Drawing Figures

FLOATING DOCK BOAT LIFT

CROSS REFERENCE TO RELATED APPLICATION

This application is a continuation-in-part application of applicant's U.S. application Ser. No. 455,128 filed Mar. 27, 1975, entitled "Boat Hoist", now abandoned, and represents an improvement in the art of dry docking for small boats.

BACKGROUND OF THE INVENTION

1. Field of the Invention

This invention relates to boat docking and more particularly to the dry-docking of small craft.

2. Description of Prior Art

Dry docks and lifting docks are a quite old art. Numerous designs have been developed and patented. Examples are U.S. patent to Rutter U.S. Pat. No. 3,362,172, and to Fort, U.S. Pat. No. 3,270,698.

SUMMARY OF THE INVENTION

Emphasis in recent years on family size pleasure boats prompted your inventor to develop this specialized buoyant dock for pleasure craft.

An object of the invention is to provide a boat lift that dry-docks a boat in a keel brace affixed to a deck by controlling the buoyancy of the deck. The deck is hinged at the end board end to a parent structure that may or may not surround the deck on three sides. At the outboard end of the deck, a relatively broad flat chamber, open at the bottom, is arranged to pipe in air from an air pump placed near the parent structure. By this means, the craft is raised out of the water to a position level with the parent structure above the surface of the water. When the boat is to be launched, a valve-controlled air-venting pipe in the top of the air chamber extends to a convenient location on or near the deck for operation of the valve. When marine plywood is used for decking, air venting is provided at a valve in each compartment to control buoyancy and permit submerging of the boat deck. To assure that the boat load has no effect on a deck structure and that the deck can remain laterally level throughout the whole movement between flooding and floating, the deck is reinforced throughout; the hinges are rugged and the keel brace is especially reinforced and strengthened to support the keel on a straight line to maintain a proper set to the boat for the entire length of the boat keel.

Another object is to provide a boat lift of the type described that can be fabricated economically for years of rugged and dependable use.

These and other objects will become evident upon a study of the following specification and the accompanying drawing, wherein identical reference numbers refer to identical or equivalent components throughout the several views and the description of the preferred embodiment.

DESCRIPTION OF THE PREFERRED EMBODIMENT

Figure 1:
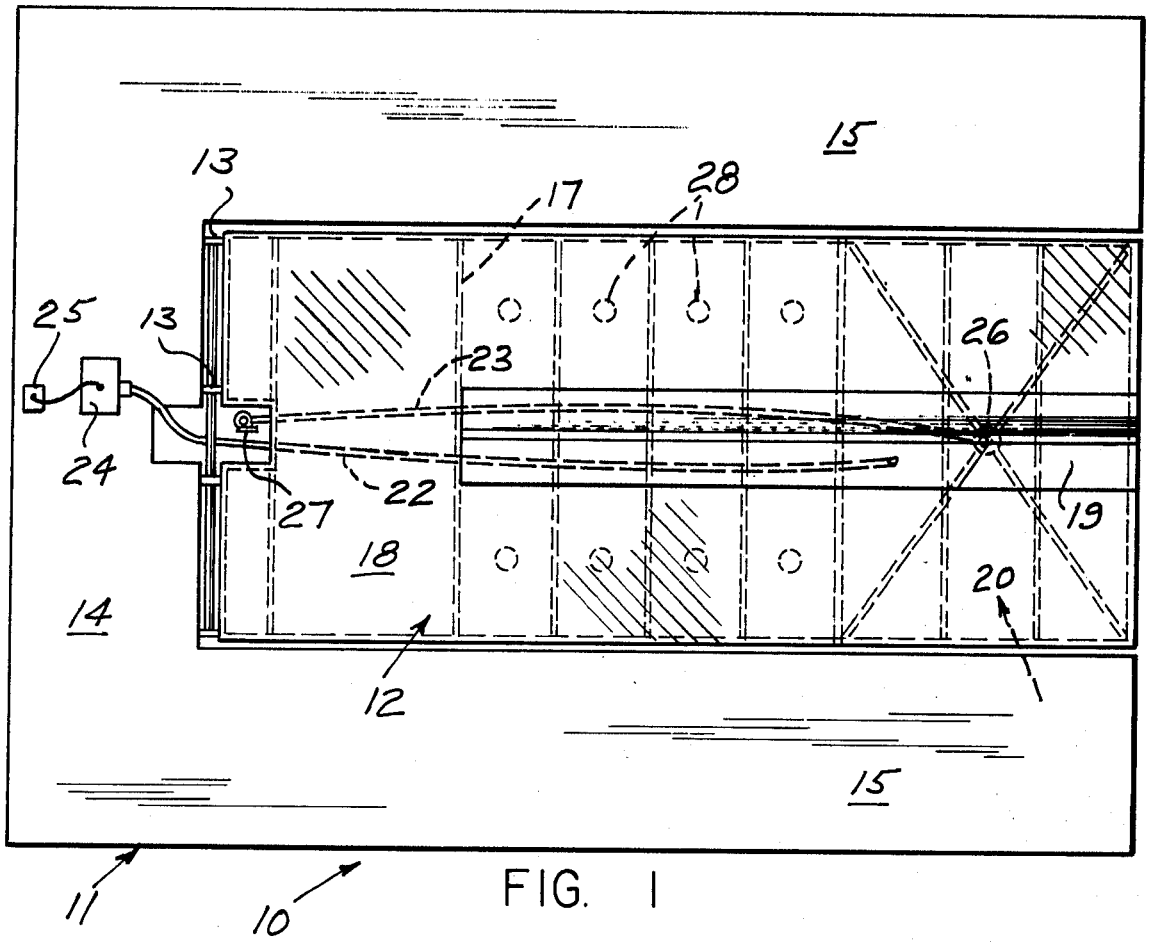
FIG. 1 is a plan view of the device.
Figure 2:
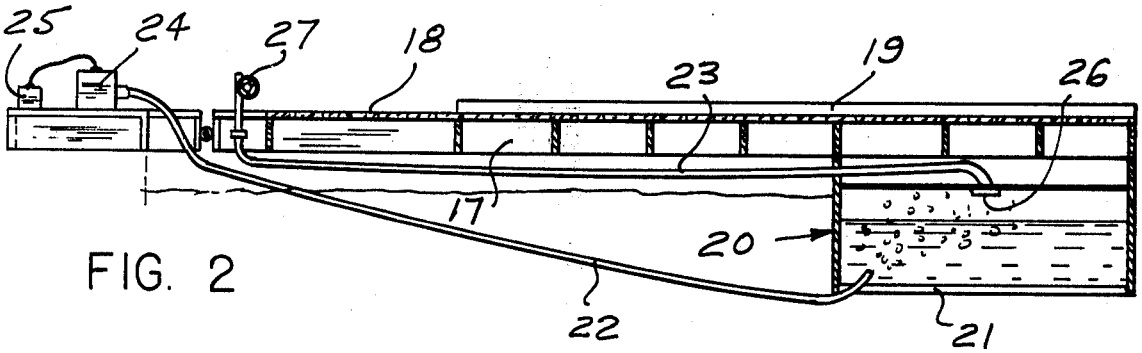
FIG. 2 is a side view of the device, partly in section.

Referring to the illustrated embodiment described by example and therefore not limiting the spirit and scope of the invention, the boat lift 10 comprises two main structures: a parent structure 11 and a boat deck 12.

Structure 11 to which deck 12 is pivotally supported at hinges 13, is shown to have an approach area 14 and two elongated work areas 15. Structure 11 may extend out into the water as indicated by extended flotation means 16 or may be anchored to the land or a combination of both.

Deck 12 shows a reinforcing structure 17, supporting a deck area 18 upon which there is fixed a keel brace 19 made up of two elongated spaced parallel members secured to the upper surface of deck 12. The keel brace will support a watercraft which is narrow enough to permit accessibility to most of the hull, yet wide enough to properly support the boat without contributing stress to the boat structure. At the outer end of deck 12, an underlying compartment 20 extends the full lateral width of the deck. The compartment is open at the bottom, such opening varying according to design and purpose from a full opening 21 to a partial opening.

The compartment 20 may be filled with air using a single hose and the air released through the same hose; however, in the preferred embodiment a first hose 22 and a second hose 23 were employed to alternately fill and empty compartment 20. In the simplest form, due to hinges 13, a hose 22 extends from structure 11 to chamber 20. A second hose 23, being integrally incorporated in the deck 12 structure, may alternately be made entirely of rigid pipe. Hose 22 is used for conducting air from an air pump 24 into opening 21. Air pump 24 may be powered by a battery 25 as shown or may be connected to a separate power source independent of the structure 11. Pipe 23 leads from an opening 26 in the top of chamber 20 to a valve 27 accessible on deck area 18.

Small compartments constructed of marine plywood are provided at the bottom surface of deck 12. Individual air-vent valves 28 may be employed for each compartment. Altenately, such valves may be grouped in any suitable manner in one or more manifolds for operation by one valve or by fewer than multi-compartment valving.

Figure 3:
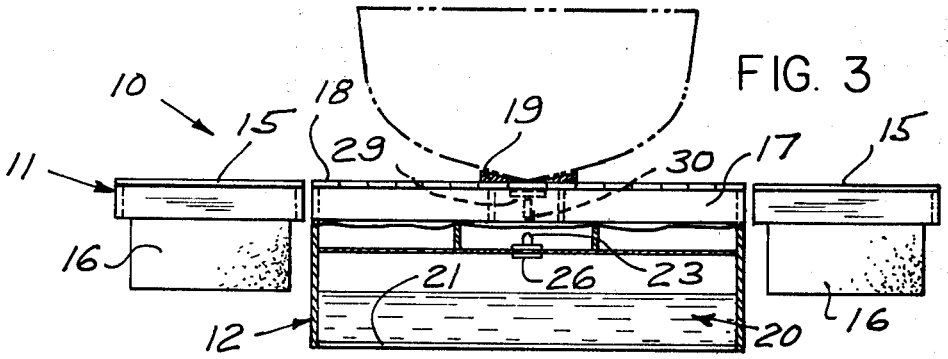
FIG. 3 is a front view of the device, partly in section.

For rigidizing the deck's structure underneath keel brace 19, additional supporting structure is provided. As best seen in FIG. 3, such structure may take the form of a wood member 29 forming a right angle with a metal reinforcing member 30 affixed thereto. A desirable alternate structure might employ a metal reinforcing member 30 between two wood members 29 in a laminated or sandwich form.

From the description and the illustration of the Figures it will become evident that the present invention features a boat lift that is rugged, is safe and reliable and is completely controllable from the submerged position wherein chamber 20 is filled with air and water to the exact buoyancy required for the exact leveling desired. There is no chance of twisting the deck, a condition that strains the hinges and at the worst might cause a loss of buoyancy. Working area around the boat can be kept clear as the boat is properly and safely supported, and docking or launching becomes an extremely simple and safe procedure.

Modification will be apparent to those skilled in the art from a study of the drawing and description.

What is desired to be claimed is all equivalent structures not departing from the scope of the appended claims.

I claim:

1. A floating dock boat lift comprising:

a. a floating parent structure moored in position on a body of water, said structure including a substantially planar upper surface, b. multiple hinges operably secured to said parent structure, said parent structure having a length and width greater than a boat dock attached thereto, c. said boat deck including a substantially planar upper surface and bottom surface operably secured to said multiple hinges in such a manner as to secure said boat deck's upper surface co-planar with said parent structure's upper surface, said boat deck having a length and width greater than the boat to be lifted by the said boat deck, d. a keel brace securely affixed to said boat deck's upper surface, said keel brace further comprising:

1. two elongated spaced substantially parallel members secured to the upper surface of the said boat deck adapted to receive and support the keel of a boat and support said boat in an upright position, 2. an underlying, reinforcing wood member secured to the under surface of said boat deck extending between and in a parallel plane to said elongated spaced parallel members, 3. a metal reinforcing member securely affixed to said underlying, reinforcing wood member and projecting for the length of said underlying reinforcing wood member and said parallel members secured to the upper surface of said boat deck, e. an airtight, underlying compartment attached to the under surface of said boat deck, said airtight compartment having an upper surface and a bottom surface, f. an opening in the bottom surface of said airtight compartment adapted to permit the flow of water to and from said airtight compartment, g. a source of air under pressure, and h. multiple valves and air hoses for controlling the flow of air to and from said airtight underlying compartment.

2. The invention of claim 1 wherein said parent structure substantially encloses said boat deck having:

a. two elongated work areas extending parallel to the said keel brace, and b. a deck area interconnecting said multiple work areas, said boat deck being hingedly secured to said parent structure.

3. The invention of claim 1 wherein said means for controlling the flow of air to and from said airtight underlying compartments further comprises:

a. a hose interconnecting said source of air under pressure to said airtight underlying compartment, b. an opening in the top of said airtight underlying compartment, and c. a valve having an open position and a closed position secured to said opening in said airtight compartment, said valve sealing said airtight compartment in the closed position and venting air from said airtight compartment in the open position.

4. The invention of claim 1 wherein said source of air under pressure comprises:

a. an air compressor mounted on said floating dock boat lift, and b. motor means for driving said air compressor.

5. The invention of claim 1 wherein said source of air under pressure comprises:

a. an electric powered centrifugal blower, and b. a battery means for powering said centrifugal blower.

6. The invention of claim 3 further comprising:

a. multiple underlying airtight compartments secured to the bottom surface of the said boat deck, and b. multiple air vent valves and associated air hoses for controlling the flow of air under pressure to and from the individual multiple underlying airtight compartments permitting adjusting lift on various areas of said boat deck.

* * * * *